US007530551B2

(12) United States Patent
Kuenzel

(10) Patent No.: US 7,530,551 B2
(45) Date of Patent: May 12, 2009

(54) CLAMPING APPARATUS AND APPARATUS FOR USE IN ERECTING TEMPORARY GUARD RAILS

(75) Inventor: Rainer Kuenzel, Hunt, TX (US)

(73) Assignee: Safety Maker, Inc., Houston, TX (US)

( * ) Notice: Subject to any disclaimer, the term of this patent is extended or adjusted under 35 U.S.C. 154(b) by 0 days.

(21) Appl. No.: 11/803,514

(22) Filed: May 15, 2007

(65) Prior Publication Data

US 2007/0241317 A1 Oct. 18, 2007

Related U.S. Application Data

(62) Division of application No. 10/890,447, filed on Jul. 13, 2004, now Pat. No. 7,234,689.

(51) Int. Cl.
*E04H 17/22* (2006.01)

(52) U.S. Cl. ..... 256/65.14; 256/59; 256/DIG. 6; 182/113

(58) Field of Classification Search ..... 256/1, 256/59, 65.14, DIG. 6; 52/182; 248/245; 182/45, 106, 113
See application file for complete search history.

(56) References Cited

U.S. PATENT DOCUMENTS 3,480,257 A * 11/1969 Bourn et al. ..... 256/59
3,747,898 A * 7/1973 Warren ..... 256/59
3,756,568 A 9/1973 Mocny et al.
3,841,609 A * 10/1974 Smith ..... 256/59
3,863,900 A 2/1975 Dagiel et al.
3,938,619 A 2/1976 Kurabayashi et al.
3,995,833 A 12/1976 McLaughlin et al.
4,307,824 A 12/1981 Malamoud
5,029,670 A 7/1991 Whitmer
5,527,016 A 6/1996 Wilkerson, Jr.
5,560,588 A * 10/1996 Hilliard ..... 256/DIG. 6
5,896,944 A 4/1999 McMillian et al.
6,039,150 A 3/2000 Palmer
6,279,880 B1 * 8/2001 Hawks, Jr. ..... 256/65.14
6,481,697 B1 11/2002 Brown
6,540,209 B2 4/2003 Ross
6,585,080 B2 7/2003 Murray
6,679,482 B2 1/2004 Allenbaugh

OTHER PUBLICATIONS

Website: www.safetrail.com Safe-T-Rail Fall Protection.
Safety Boot Trifold Brochure & Full Page Color Insert.

* cited by examiner

*Primary Examiner*—Michael P Ferguson
(74) *Attorney, Agent, or Firm*—Browning Bushman PC

(57) ABSTRACT

An apparatus for use in clamping a structure at its edge, the structure having opposed surfaces, the apparatus comprising a stanchion, a first clamping assembly attached to the stanchion and a second clamping assembly selectively slidably moveable longitudinally along the stanchion, the second clamping assembly including a support plate extending laterally outward in a direction away from the stanchion, the support plate being positioned closely adjacent one of the opposed surfaces of the structure when the structure is clamped between the first and second clamping assemblies.

23 Claims, 10 Drawing Sheets

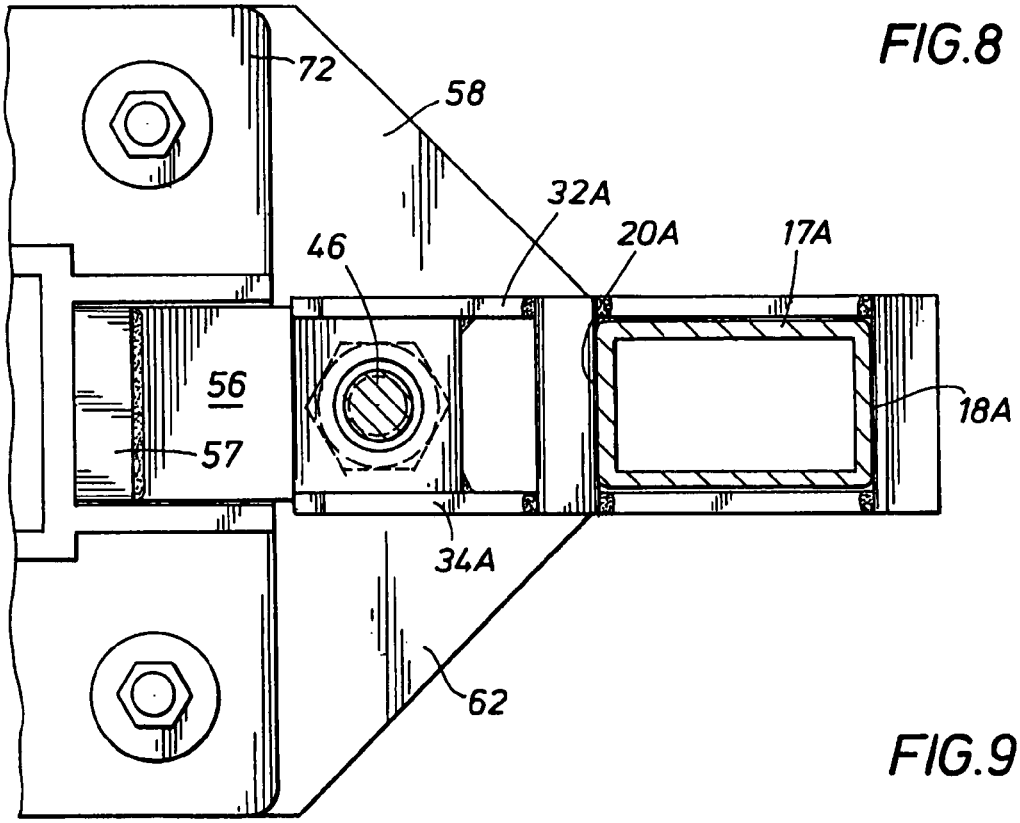
FIG.8
FIG.9
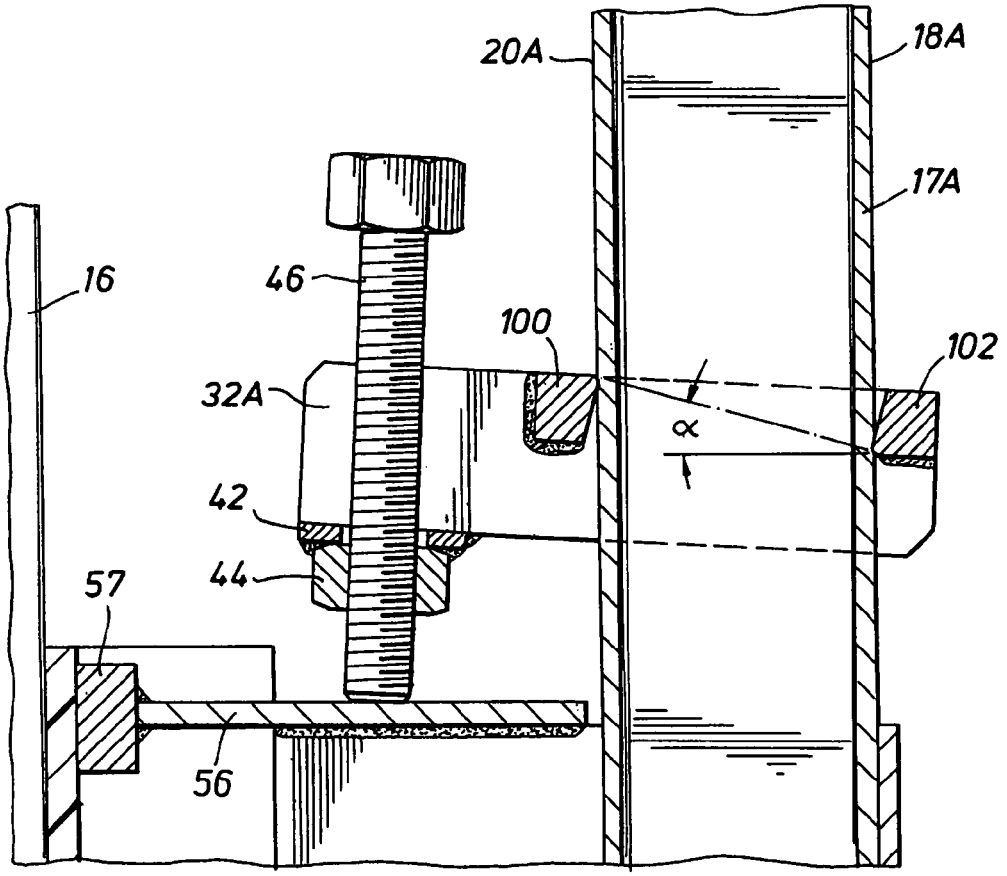

FIG.10
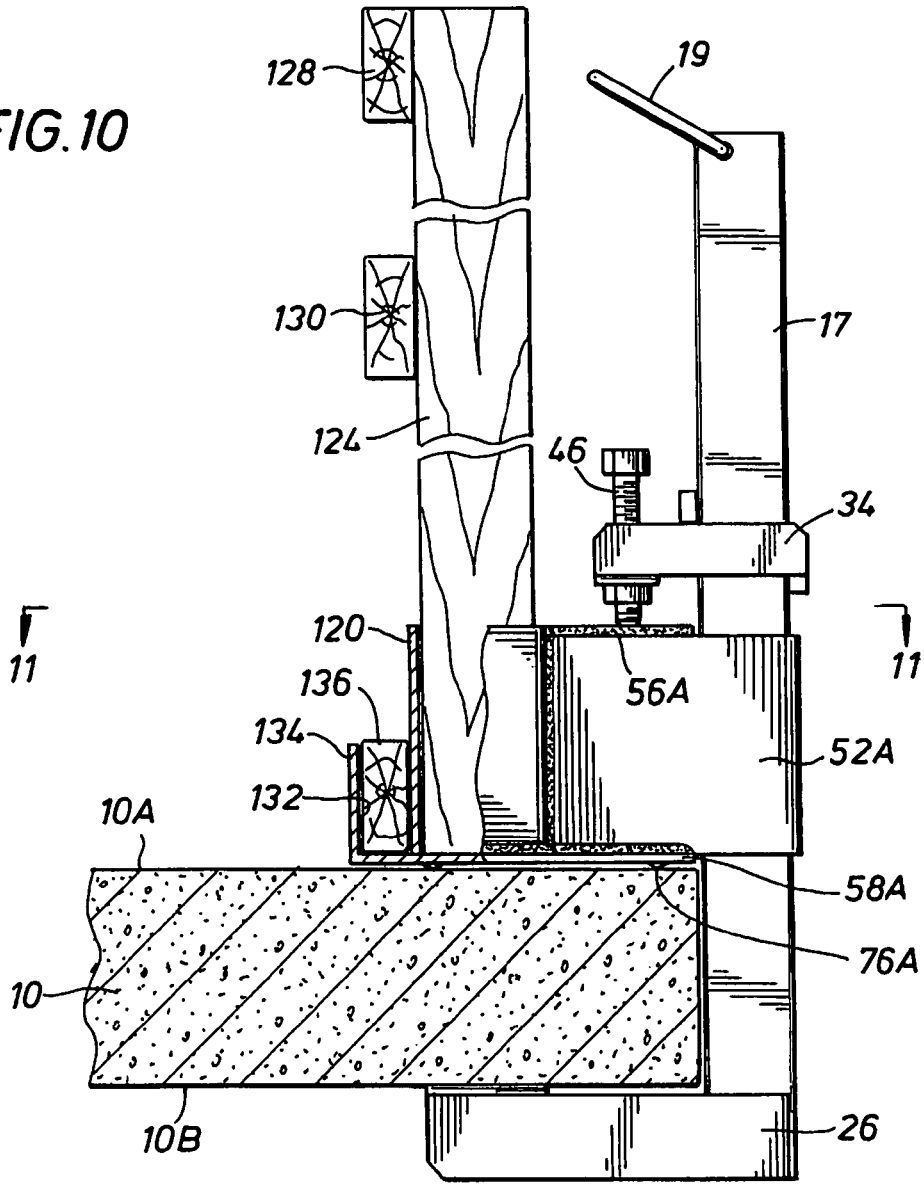
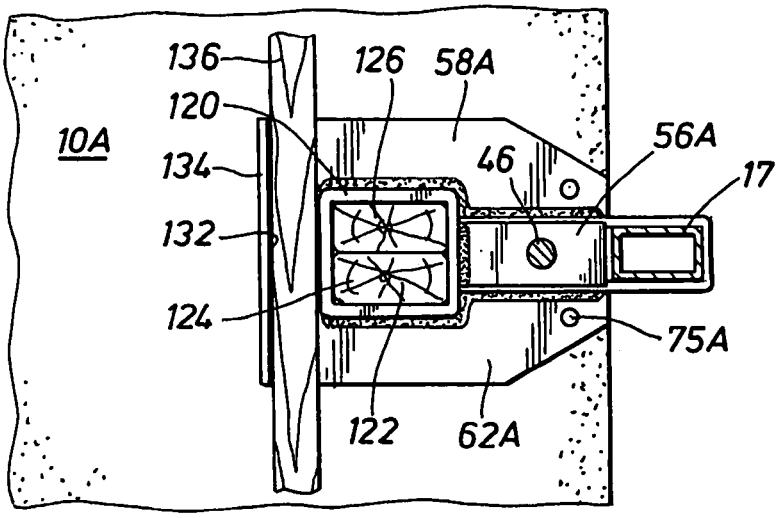
FIG.11

264
260
242
240
70
228
244
204
216
218
220
208
210
204
214
212

CLAMPING APPARATUS AND APPARATUS FOR USE IN ERECTING TEMPORARY GUARD RAILS

CROSS REFERENCE TO RELATED APPLICATIONS

This application is a divisional of U.S. patent application Ser. No. 10/890,447 filed on Jul. 13, 2004, now U.S. Pat. No. 7,234,689 for Clamping Apparatus and Apparatus for Use in Erecting Temporary Guard Rails, the disclosure of which is incorporated herein by reference.

BACKGROUND OF THE INVENTION

1. Field of the Invention

The present invention relates to temporary guard rail systems disposed at the peripheral edge of a structure such as an elevated floor slab. More generally, the present invention relates to a clamping apparatus that can be used, inter alia, in the erection of such a temporary guard rail system.

2. Description of the Prior Art

In the construction industry, commercial, industrial and multi-unit residential buildings are typically constructed with a framework of steel girders. The framework for the various floor levels as formed, concrete floor slabs are poured so that the workmen on the project have floor support upon which to perform their task. Since the floor slabs are poured before the building walls are constructed, it is important to create some type of perimeter guard at the edges of the floor slabs to prevent workers from inadvertently falling off the edge of a floor slab without realizing they are near the edge. Additionally, perimeter guard rails, to meet certain governmental standards, have to have a toe board that generally abuts the top surface of the slab so as to prevent tools and construction materials from falling off the edge of the slab onto workers below.

For many years temporary guard rails forming perimeter guards for floor slabs in a multi-story building or the like have been provided by installing temporary stanchions or posts at spaced internals around the perimeter of an elevated floor slab. The posts or stanchions provide vertical supports to which horizontal guard rails can be attached to form the temporary guard rail around the perimeter of the floor slab.

Typical of systems used in constructing temporary guard rails or other perimeter guard constructions are those disclosed in U.S. Pat. Nos. 3,863,900; 3,995,833; 4,307,824; 5,029,670; 6,585,080; and 6,679,482.

In U.S. Pat. No. 5,560,588 there is disclosed a support for a temporary guard railing that comprises a base adapted to be removably attached to a floor surface, e,g., the surface of a slab, and support walls upstanding from the base and defining between them an inwardly opening socket for receipt of a post. At least one pair of parallel rail guide flanges are adjoined to the base and project laterally outwardly with respect to one of the support walls whereby a rail such as a 2×4 can be received between the rail guide flanges. The support disclosed in U.S. Pat. No. 5,560,588 has found widespread success in the construction industry, particularly, in use in forming temporary guard rails around wooden floors, stairs and the like. Further, while the support system disclosed in U.S. Pat. No. 5,560,588 can be employed with concrete slabs, stairs and the like, it suffers from the. disadvantage that in such circumstances holes must be drilled into the concrete slab in order to mount the support. This is time consuming and furthermore requires, in many cases, that the drill holes be patched once the temporary guard rail system is removed.

Aside from erecting temporary guard rails along the peripheral edges of floor slabs, stairs and the like, clamp assemblies that can be used to clamp along the peripheral edge of a slab, stairs, or similar structure, have a wide variety of uses in addition to being used in the construction of a temporary guard rail.

SUMMARY OF THE INVENTION

In one preferred embodiment, the present invention provides an apparatus for clamping a structure at its edge, the structure having opposed, generally upper and lower surfaces. The clamping apparatus includes a stanchion and a first clamping assembly attached, generally fixed, to the stanchion. There is a second clamping assembly that is selectively, slidably moveable longitudinally along the stanchion, the first and second clamping assemblies being adapted to clamp a structure therebetween. The second clamping assembly includes a support plate that extends laterally outward in a direction away from the stanchion, e.g., generally inwardly of the edge of the structure being clamped. The support plate is positioned closely adjacent a surface of the structure when the structure is clamped between the first and second clamping assemblies, and is in operative compressive engagement with such surface of the structure being clamped.

In another preferred embodiment, the present invention provides an apparatus for use in erecting a temporary guard rail, the apparatus comprising a stanchion and a first clamping assembly attached, generally fixedly, to the stanchion. There is a second clamping assembly selectively slidably moveable along the stanchion, the second clamping assembly including a support plate extending laterally outwardly in a direction away from the stanchion, i.e., generally inwardly from the edge of the structure being clamped. There is a holder for a selectively removable post for a temporary guard rail, the holder comprising a base adapted to be removably attached to the support plate. Support walls, upstanding from the base, define an upwardly opening socket for receipt of a post. There are also at least one pair of rail guide flanges adjoining the base of the holder, which project laterally outwardly with respect to one of the support walls, the spacing between the guide rail flanges being dimensions so as to receive a toe board therebetween.

BRIEF DESCRIPTION OF THE DRAWINGS

FIG. 8 is a top, plan view of an embodiment of the present invention shown in FIG. 9.

FIG. 9 is a view similar to FIG. 7 showing a portion of the second clamping assembly used in the apparatus of the present invention.

FIG. 10 is an elevational view, partly in section, showing another embodiment of the clamping apparatus of the present invention.

FIG. 11 is a view taken along the lines 11-11 of FIG. 10.

FIG. 13 is an elevational view, partly in section, showing another embodiment of the clamping apparatus of the present invention.

DESCRIPTION OF THE PREFERRED EMBODIMENTS

As used herein, the term "structure," "structural members" or any variation thereof, with which the apparatus of the present invention would be used, is intended to mean a slab, concrete or otherwise, a parapet, a stair, or for that matter, any structural body that has a peripheral edge or edges and that has opposed surfaces, e.g., top and bottom, which can be engaged by the clamping apparatus of the present invention in a compressive type engagement.

Figure 1:
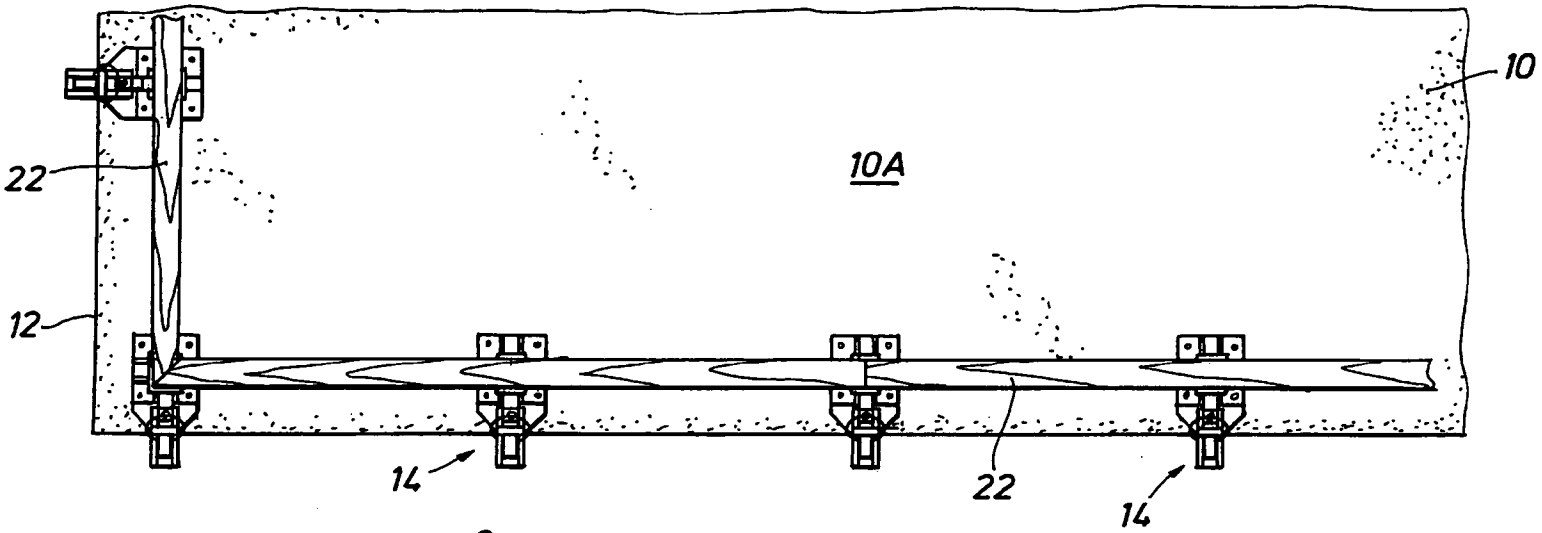
FIG. 1 is a plan view of a portion of a guard rail system constructed using the apparatus of the present invention.
Figure 2:
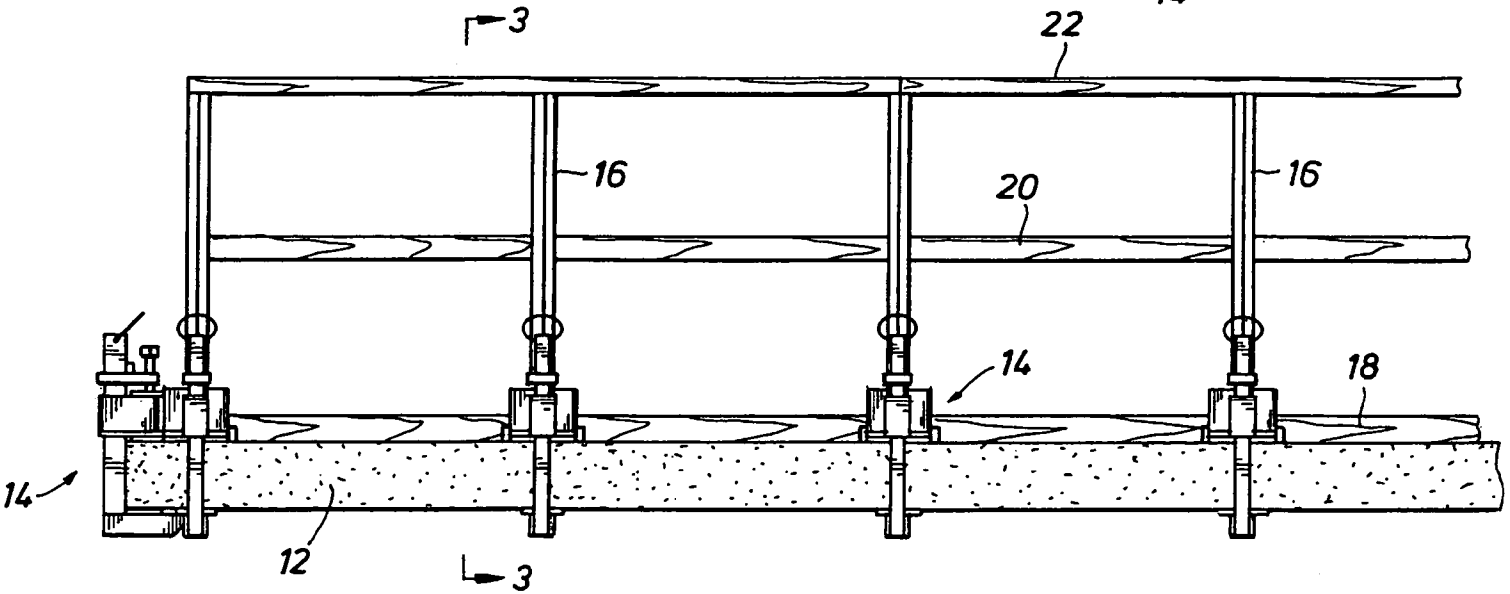
FIG. 2 is an elevational view of the guard rail system shown in FIG. 1.

Referring then to FIGS. 1 and 2, a temporary guard rail system employing the apparatus of the present invention is shown. A slab shown generally as 10, which could be the floor of a multi-story structure, has a peripheral edge 12. Spaced at intervals along the peripheral edge 12 are a series of clamping apparatuses shown generally as 14 and described more fully below. A temporary guard rail system comprising generally vertically, upwardly extending support posts 16, supported by clamping apparatus 14, toe boards 18, mid rails 20, and top rails 22 extends around the periphery 12 of the slab 10. Although, as shown, the temporary rail is comprised of wood, e.g., 2×4's and the like, it will be recognized that it could be made of steel, aluminum or other materials, if desired.

Figure 3:
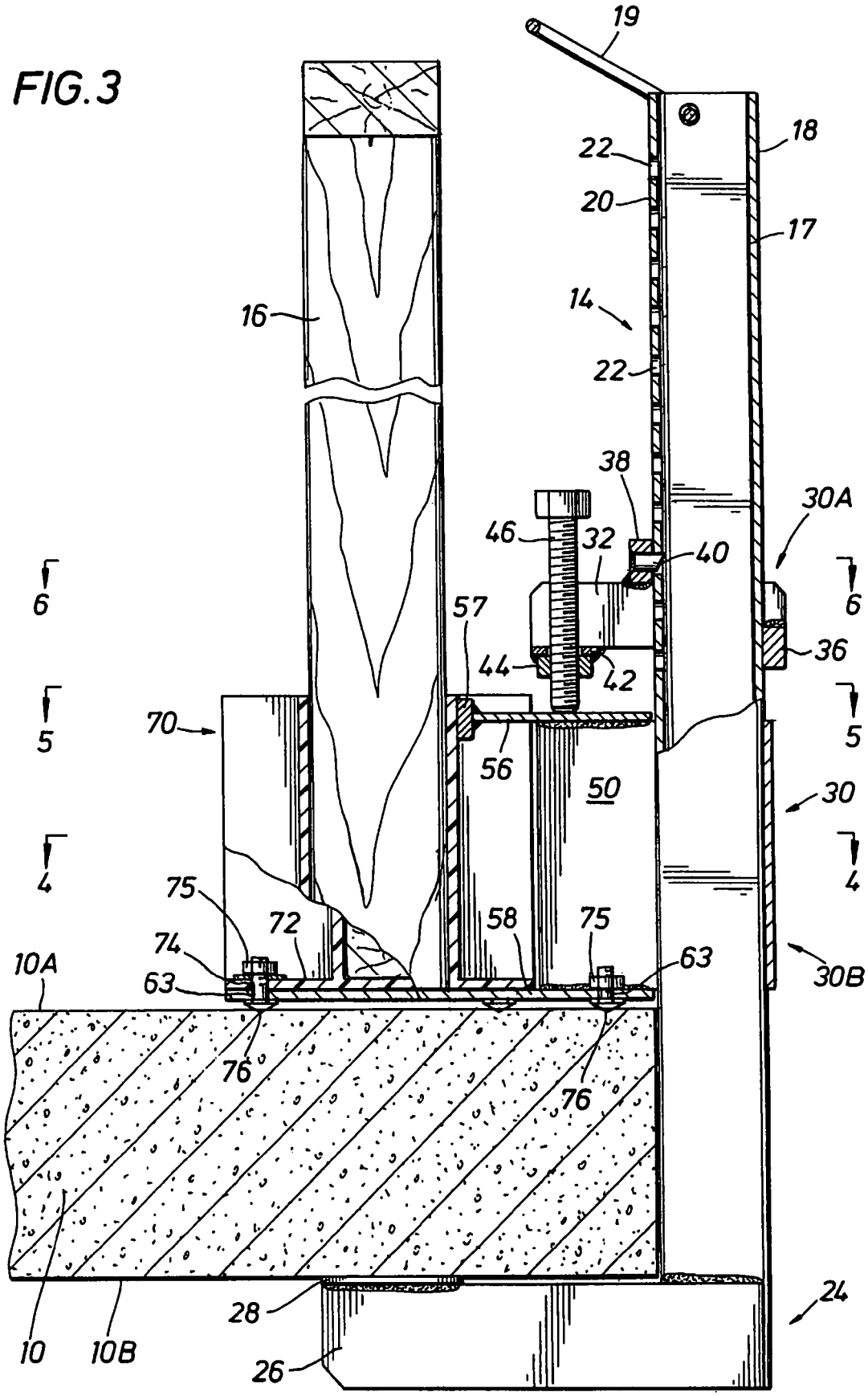
FIG. 3 is an elevational view, partly in section, taken along the lines 3-3 of FIG. 2.

Turning now to FIG. 3, there is shown in greater detail the clamping apparatus of the present invention. Clamping apparatus 14 comprises a stanchion 17 having a front surface 18 and a back, opposed surface 20, surface 20 being provided with a series of apertures 22 spaced longitudinally therealong. At its lower end, stanchion 17 is welded to a first clamping assembly shown generally as 24, which can conveniently comprise a pair of side support plates 26 to which, in turn, is welded a plate 28 that extends laterally outwardly from support plates 26.

While first clamping assembly 24, as shown, is fixedly attached to stanchion 17, it will be appreciated that provision could be made to have clamping assembly 24 slidably moveable along stanchion 17.

Figure 6:
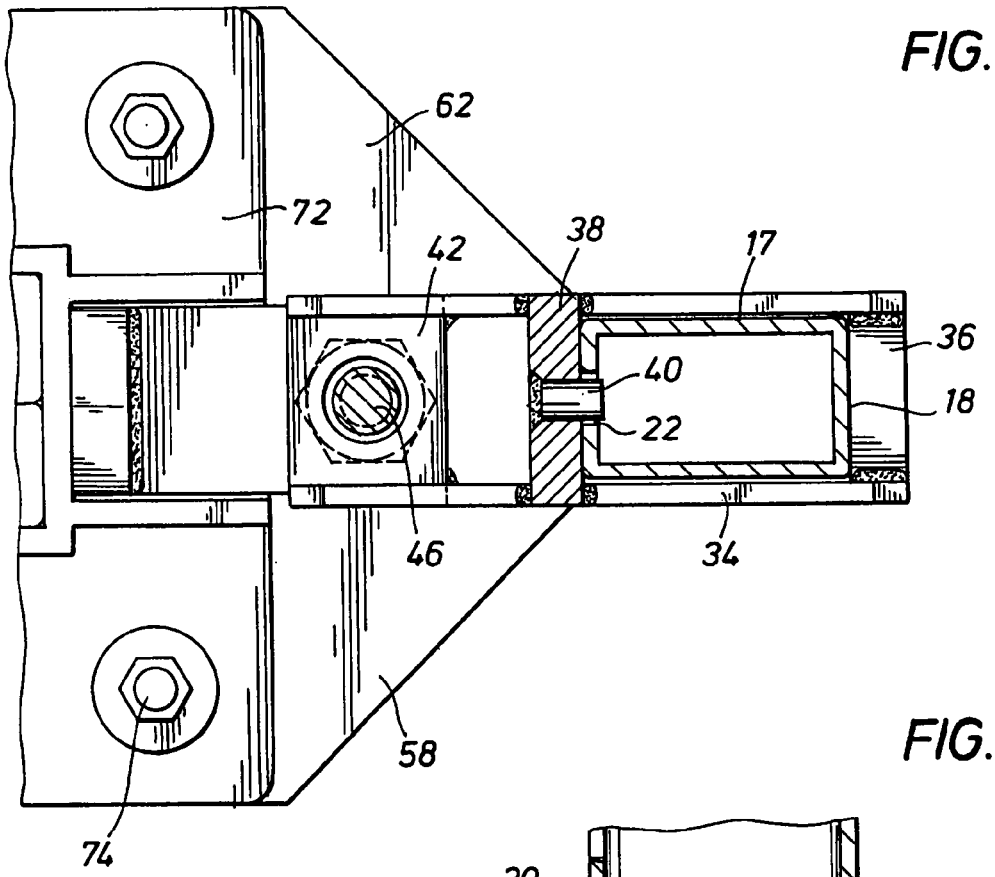
FIG. 6 is a cross-sectional view taken along the lines of 6-6 of FIG. 3.
Figure 7:
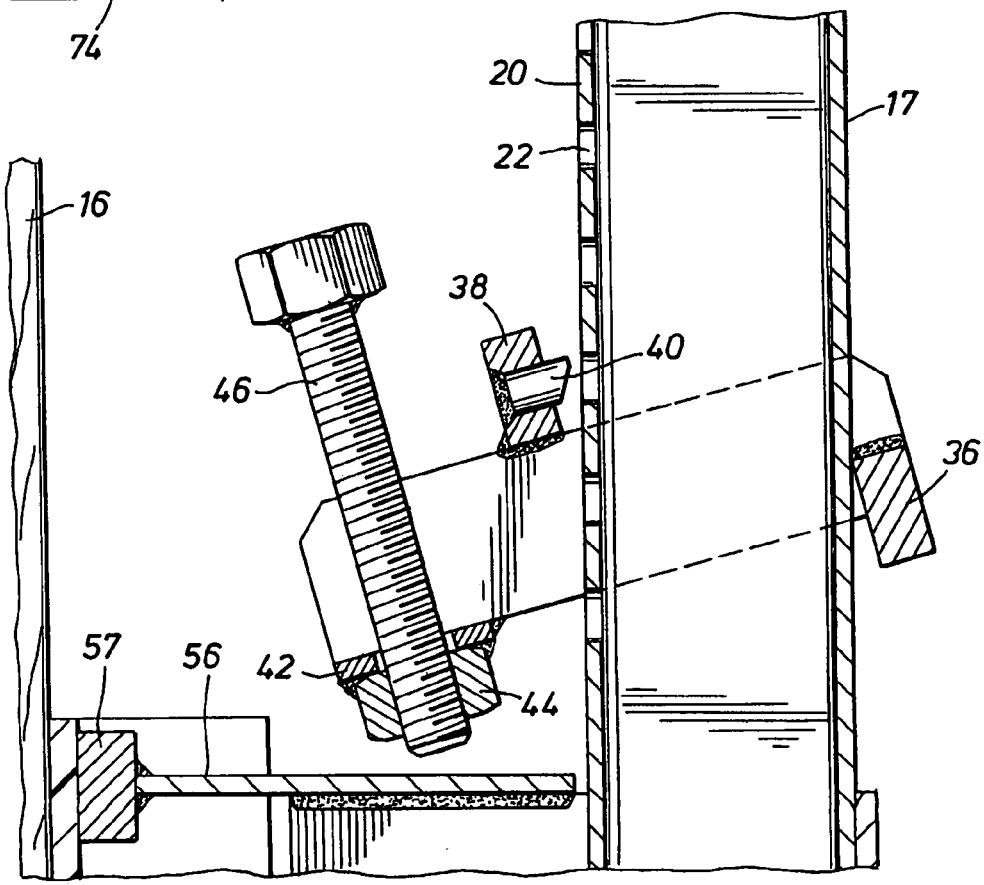
FIG. 7 is an elevational view, partly in section, showing a portion of the second clamping assembly used in the apparatus depicted in FIG. 3.

There is also a second clamping assembly shown generally as 30 that basically comprises two main components, 30A and 30B. Component 30A is comprised of a collar formed by spaced first and second plates 32 and 34, which are attached to a rib 36 welded therebetween, rib 36 being adjacent front surface 18 of stanchion 17. A second rib 38, spaced from rib 36, is welded to plates 32 and 34, plates 32, 34 and ribs 36 and 38 serving to form a collar that is slidably mounted on stanchion 17. Stanchion 17 is provided at its upper end with a stop 29 that prevents the collar from being inadvertently removed or slipping off when the apparatus is being moved from job site to job site. Rib 38 carries a fixed dog 40, which as shown in FIGS. 3 and 6, is received in one of the apertures 22. Plates 32 and 34, together with attached cross-member 42, form a frame extending outwardly from back surface 20 of stanchion 17. Welded to the underside of cross-member 42 is a threaded nut 44 in which is threadedly received a bolt 46.

Figure 4:
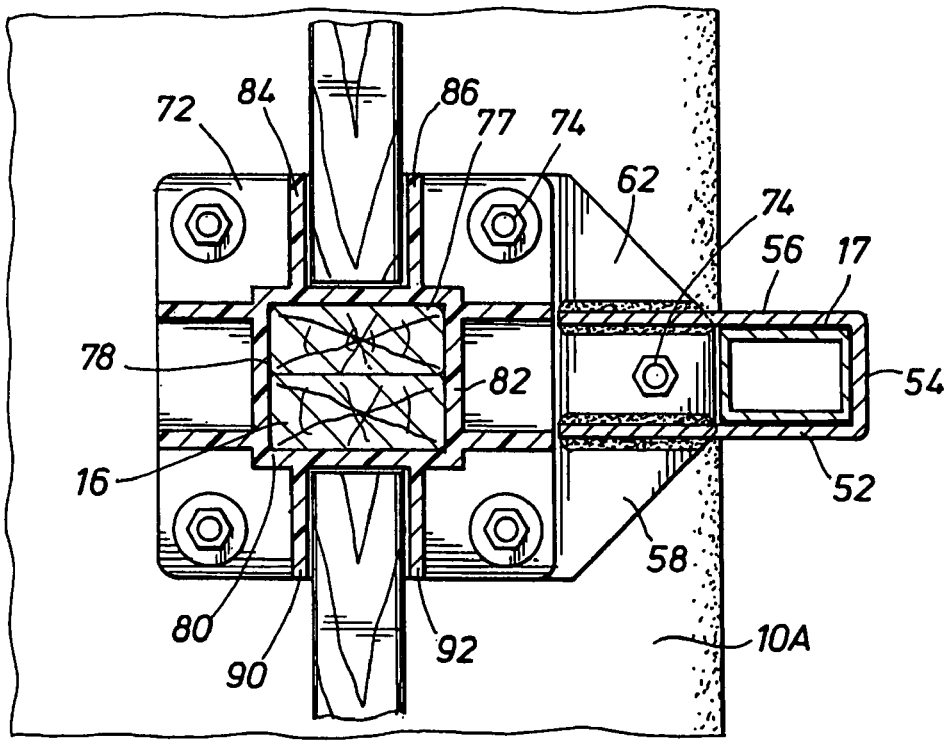
FIG. 4 is a cross-sectional view taken along the lines 4-4 of FIG. 3.
Figure 5:
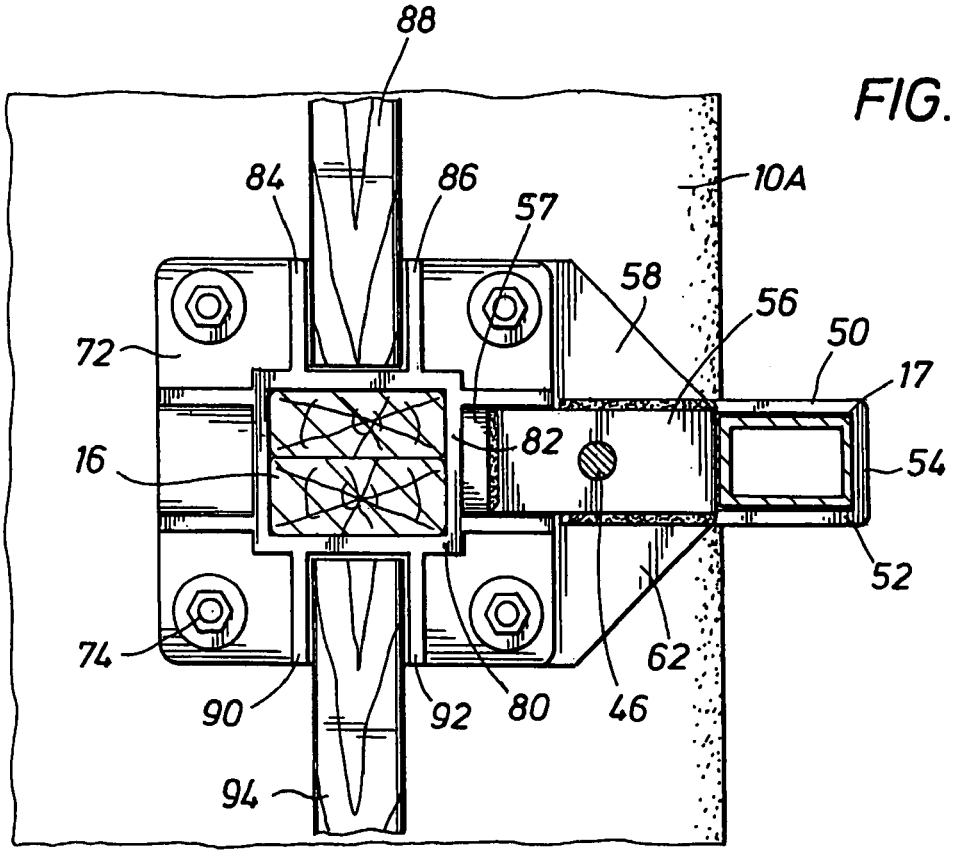
FIG. 5 is a cross-sectional view taken along the lines of 5-5 of FIG. 3.

Turning now to component 30B of second clamping assembly 30, and as best seen with respect to FIGS. 3, 4 and 5, there is a second collar formed by a generally U-shaped member having a first leg 50, a second leg 52, legs 50 and 52 being interconnected by a web 54. Legs 50 and 52 are welded to a top or bearing plate 56, portions of legs 50 and 52, web 54 and the edge of bearing plate 56 adjacent surface 20 of stanchion 17 forming a collar slidably moveable on stanchion 17. Legs 50 and 52 are also welded to a base plate 58 that extends laterally outwardly away from stanchion 17, i.e., in a direction away from surface 20. Effectively, the portion of legs 50 and 52 welded to support plate 58 and bearing plate 56 form a second frame which is longitudinally movable, relative to stanchion 17, with the collar formed by legs 50 and 52, web 54 and bearing plate 56.

As best seen in FIGS. 3, 4 and 5, support plate 58 comprises a generally rectangular portion 60 and a generally trapezoidal portion 62. Support plate 58 is provided with a series of bores 63, four of such bores being in the rectangular portion 60 of base plate 58 and one of said bores 63 being in the generally trapezoidal portion 62 of support plate 58.

Secured to support plate 58 is a holder, shown generally as 70, in which is removably positioned post 16. Holder 70 comprises a base 72 in which are four holes 74 which are in register with the four holes 63 in support plate 58. Base 72 of holder 70 is connected to support plate 60 by means of nut/bolt assemblies 75. The heads of nut/bolt assemblies 75 are provided with projections 76 that are generally sharp or roughened surface and that can bite into the top surface 10A of slab 10. In like fashion, similar nut/bolt assemblies 75 that are received through the bore in the trapezoidal portion 62 of support plate 58 have a similar projection that likewise can bite into the surface 10A of slab 10. It will be understood that rather having biting projections on the heads of the nut bolt assemblies 75, it is possible to provide the underside or bottom surface of support plate 58 with integral projections or a roughened surface which would accomplish the same function. Further, nut/bolt assemblies could be dispensed with in lieu of four threaded studs welded to plate 58, i.e., the nuts would be received on the threaded studs.

It will also be understood that while support plate 58, when such projections are present, will not lie directly against the surface 10A of slab 10, it is closely adjacent such that when the clamping assembly clamps slab 10 therebetween, support plate 58 is effectively, operatively compressively engaged with the surface 10A of slab 10. Accordingly, any reference to support plate 58 being "adjacent" or "closely adjacent" to surface 10A is intended to take into account a spacing or standoffbetween support plate 58 and surface 10A occasioned by the thickness of the heads of the connector 75 and/or any projections, etc. that are integrally formed on the bottom surface of support plate 58.

Returning to the construction of holder 70, there are four upstanding support walls 77, 78, 80 and 82, which are attached to base 72. Adjoining base 72 and projecting laterally outwardly from support wall 76 are a pair of rail guide flanges 84 and 86 which, as seen in FIGS. 4 and 5, are dimensioned so as to receive a toe board, generally a 2×4, therebetween. In like fashion, a pair of guide flanges 90 and 92 adjoin base 72 and project outwardly laterally from support wall 80 in generally parallel alignment with flanges 84 and 86. A second toe board 94 is received in the space between flanges 90 and 92 in the manner described above with respect to toe board 88. As can be seen in FIGS. 4 and 5, there are also rail guide flanges, essentially the same as flanges 84, 86 and 90, 92, that are attached to base 72, are orthogonal to flanges 84, 86, 90 and 92 and that project laterally outwardly from support walls 78 and 82. As seen in FIG. 5, a pair of the rail guide flanges form a channel for receiving the end of bearing plate 56 distal stanchion 17 to which is attached abutment 57 that abuts wall 82 of holder 70. Basically holder 70 is essentially as described in U.S. Pat. No. 5,560,588, the disclosure of which is incorporated herein by reference for all purposes.

In any event, as can be seen with reference to FIG. 3, when holder 70 is secured to support plate 58 by means of nut/bolt assemblies 75 and with plate 28 of clamping assembly 24 engaging surface 10B of slab 10 and support plate 58, via projections 76, engaging surface 10A of slab 10, when dog 40 is received in the appropriate aperture 22 and bolt 46 tightened against bearing plate 56, support plate 58 will be effectively compressively urged against surface 10A. In this respect, and as noted, while the heads of nut/bolt assemblies 75 and projections 76 may prevent direct contact between support plate 58 and the surface 10A of slab 10, support plate 58 is effectively operatively compressively engaged against slab 10. Because holder 70 is secured to support plate 58 as described above, holder 70 is effectively clamped to slab 10 without the need for drilling holes in slab 10.

FIGS. 8 and 9 depict a slightly different embodiment of component 30A of second clamping assembly 30. In this regard, plate 32A and a corresponding, spaced plate 34A are interconnected by means of elongate teeth 100 and 102, plates 32A and 34A, together with teeth 100 and 102 forming a collar that is slidably moveable on stanchion 17A, tooth 100 being positioned to engage back surface 20A of stanchion 17A, tooth 102 being positioned to engage front surface 18A of stanchion 17A. As can be seen, when screw 46 is tightened into nut 44 and urged compressively against bearing plate 56, because of the angle alpha at which the teeth 101 and 102 are disposed, component 30A will be cocked as nut 46 is tightened against bearing plate 56, causing teeth 100 and 102 to bite into surfaces 20A and 18A, respectively.

Figure 12:
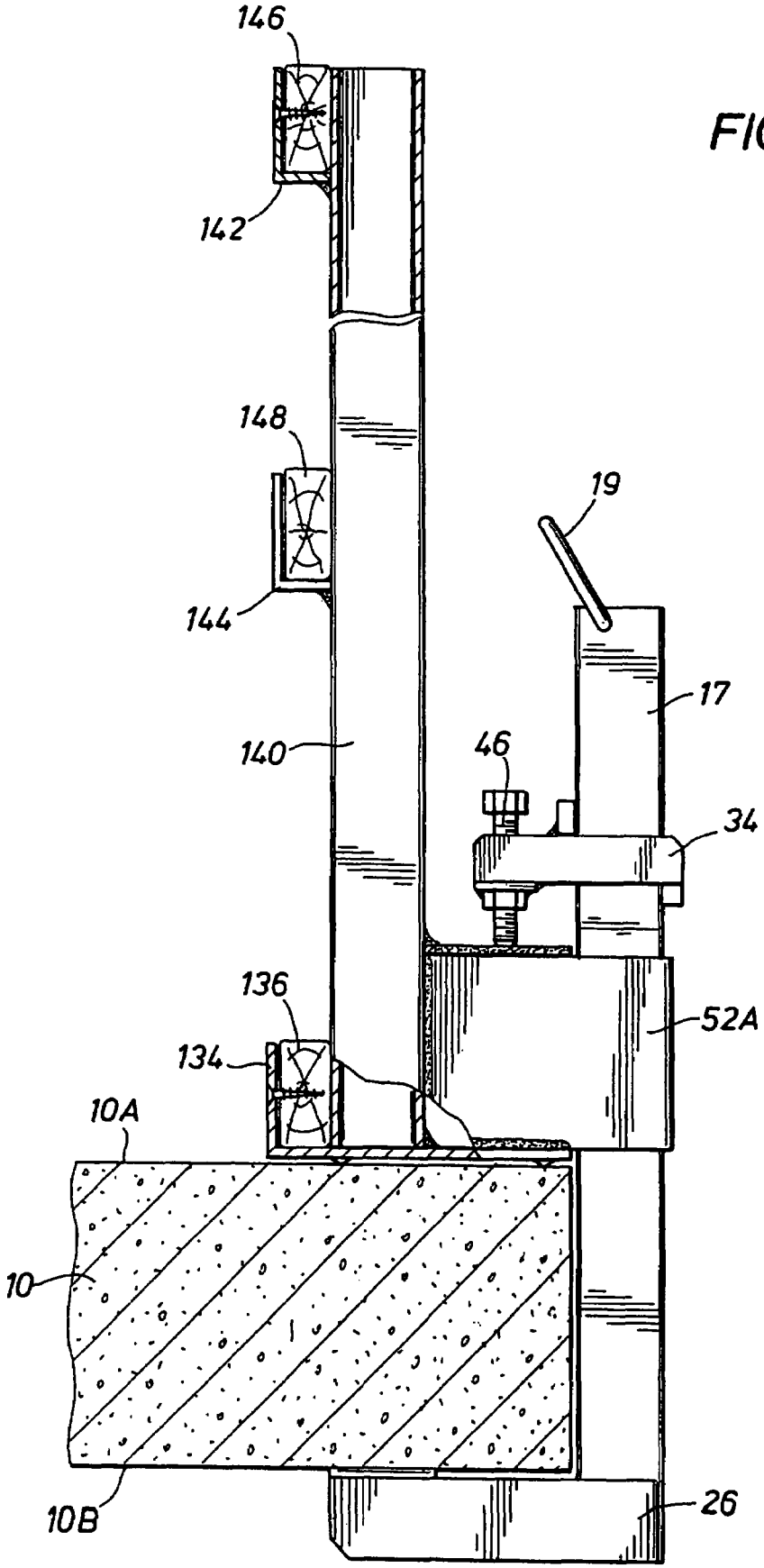
FIG. 12 is an elevational view, partly in section, showing still another embodiment of the clamping apparatus of the present invention.

Turning now to FIGS. 10, 11 and 12, there are shown modified embodiments of the present invention. With reference first to FIG. 10, the embodiment shown therein differs from the embodiments shown in FIG. 3 in that instead of the holder 70 described with reference to the embodiment shown in FIG. 3, there is a socket forming member 120 secured to support plate 58A and side plates 50A and 52A, socket forming member 120 forming a socket 122 in which is received a pair of 2×4's 124 and 126, 2×4's 124 and 126 cooperating to form a vertical post to which can be attached side rails 128 and 130 by suitable fasteners such as nails, screws or the like. Additionally, there is a channel 132 formed by an L-shaped extension 134 of support plate 58A. Received in channel 132 is a toe board 136. As can also be seen, particularly in FIG. 11, there are two nut/bolt assemblies 75A that are received in section 62A of support plate 58A, the nut/bolt assemblies with projections 76A being positioned such that they are on either side of a line passing through the long azis of bolt 46. Accordingly, as bolt 46 is tightened, the force transmitted to support plate 58A is more evenly distributed ensuring good compressive engagement between support plate 58A and surface 10A.

Referring now to FIG. 12, there is shown a slightly modified embodiment of the apparatus of the present invention shown in FIGS. 10 and 11. The embodiment of FIG. 12 differs from that shown in FIGS. 10 and 11 in that instead of the upward post being formed by two 2×4's 124 and 126, received in a socket 122, there is a metal post 140 that is welded to support plate 58A and has secured thereto a series of L-shaped brackets 142 and 144 in which can be received generally horizontally extending side rails 146 and 148, respectively.

Figure 14:
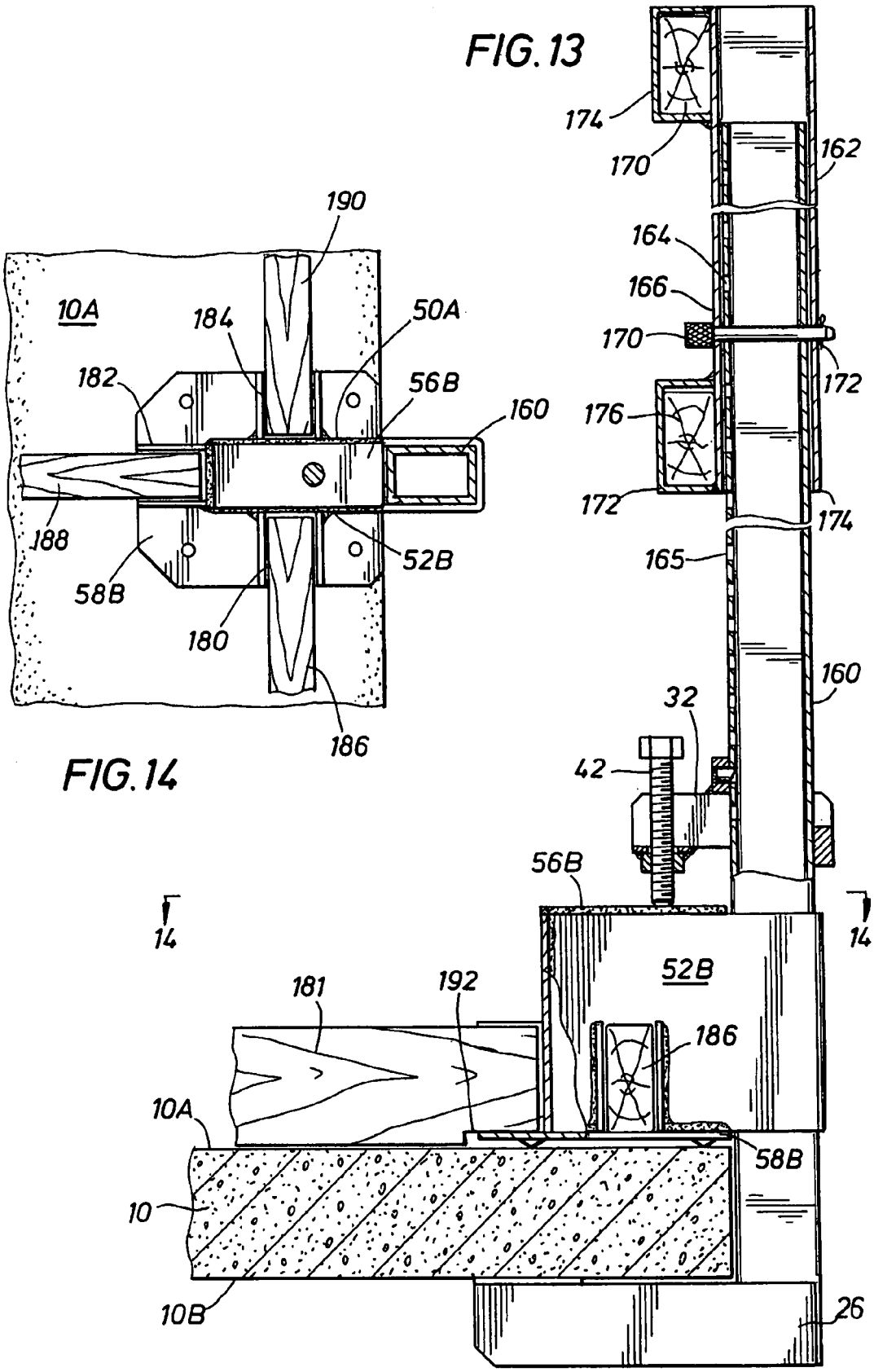
FIG. 14 is a view taken along the lines 14-14 of FIG. 13.

Turning now to FIGS. 13 and 14, there is shown still another embodiment of the apparatus of the present invention. In the embodiment shown in FIGS. 13 and 14, the stanchion 17A serves as the upright post or support for the horizontal rail members to form the temporary guard rail. As can be seen, stanchion 17A is comprised of a fixed section 160 and a moveable section 162, section 162 being telescopically received over section 160 although it could be received telescopically in section 160 or otherwise be attached to be slidably moveable with respect to section 110. Section 160 has a series of longitudinally spaced holes 164, the holes 164 being on opposite faces or surfaces of fixed section 160 and being in register with one another. There are also holes 165 in the lower portion of section 160 to accommodate dog 40 as described above with respect to FIG. 3. Moveable section 162 is provided with first and second bores 166 in opposed faces of moveable section 162. When holes 166 are in register with one of the sets of holes 164 in fixed section 160, a pin 170 can be inserted so as to prevent relative longitudinal movement between fixed section 160 and moveable section 162. As seen, a cotter key 172 can be inserted to prevent the inadvertent removal of pin 170. In this manner, stanchion 17A can be adjusted to the desired height to form the upright post of a temporary guard rail system so as to take into account slabs of varying therebetween.

As can be seen from FIG. 13, fixed section 162 has a plurality of vertically spaced collars 170 and 172 in which are received side rails 174 and 176. Secured to side plates 50B and 52B, and to support plate 58B are a series of spaced flanges forming channels 180, 182 and 184. Channels 180, 182 and 184 are dimensioned so as to receive toe boards 186, 188 and 190, respectively. As best seen with FIG. 13, the toe boards are notched as at 192 to insure the bottom edge of toe boards, is closely adjacent surface 10A of slab 10 to prevent tools or other objects from falling off of slab 10 onto workers below.

Figure 15:
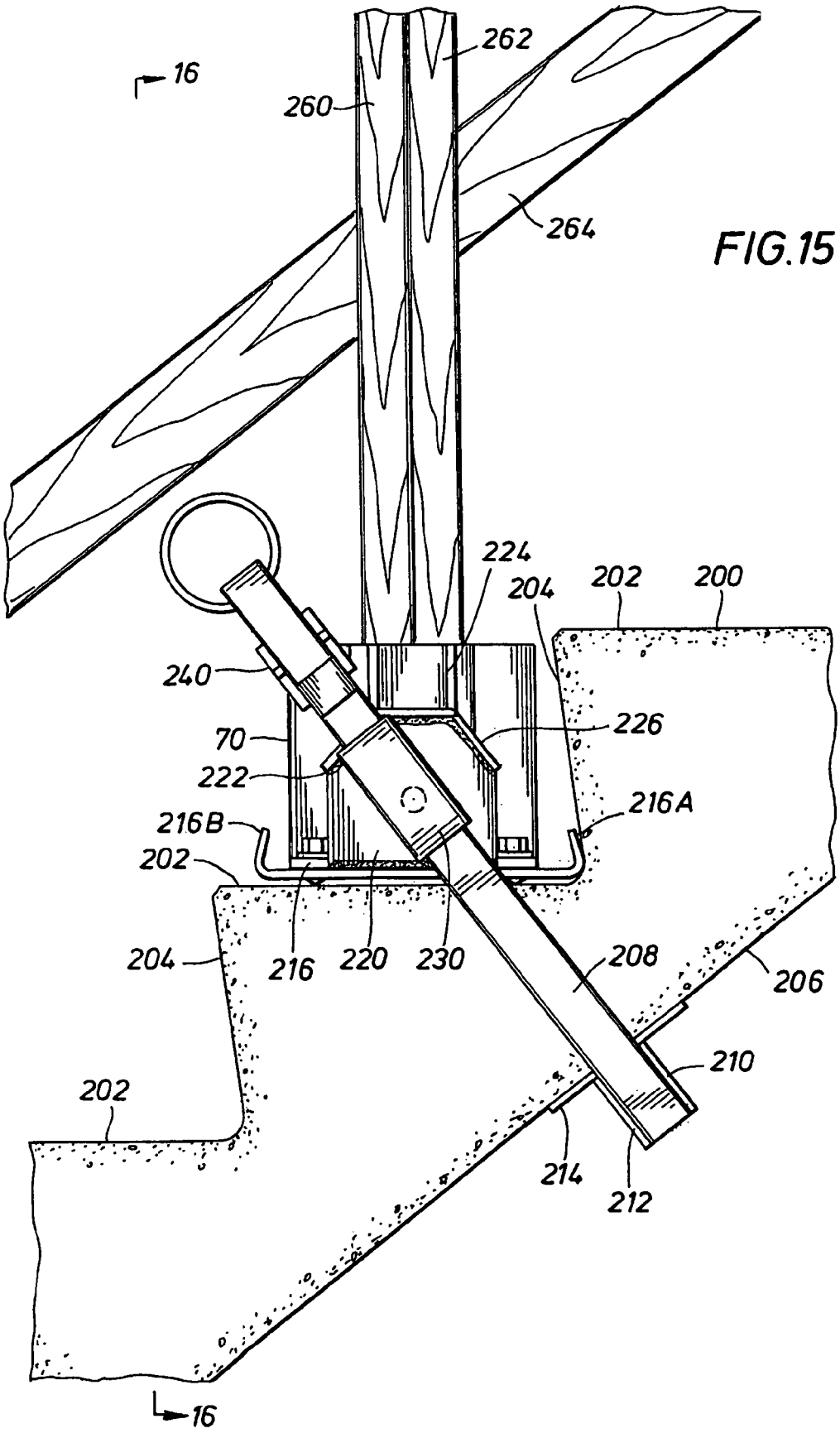
FIG. 15 is an elevational view of another embodiment of the clamping apparatus of the present invention and FIG. 16 is a view taken along the lines 16-16 of FIG. 15.
Figure 16:
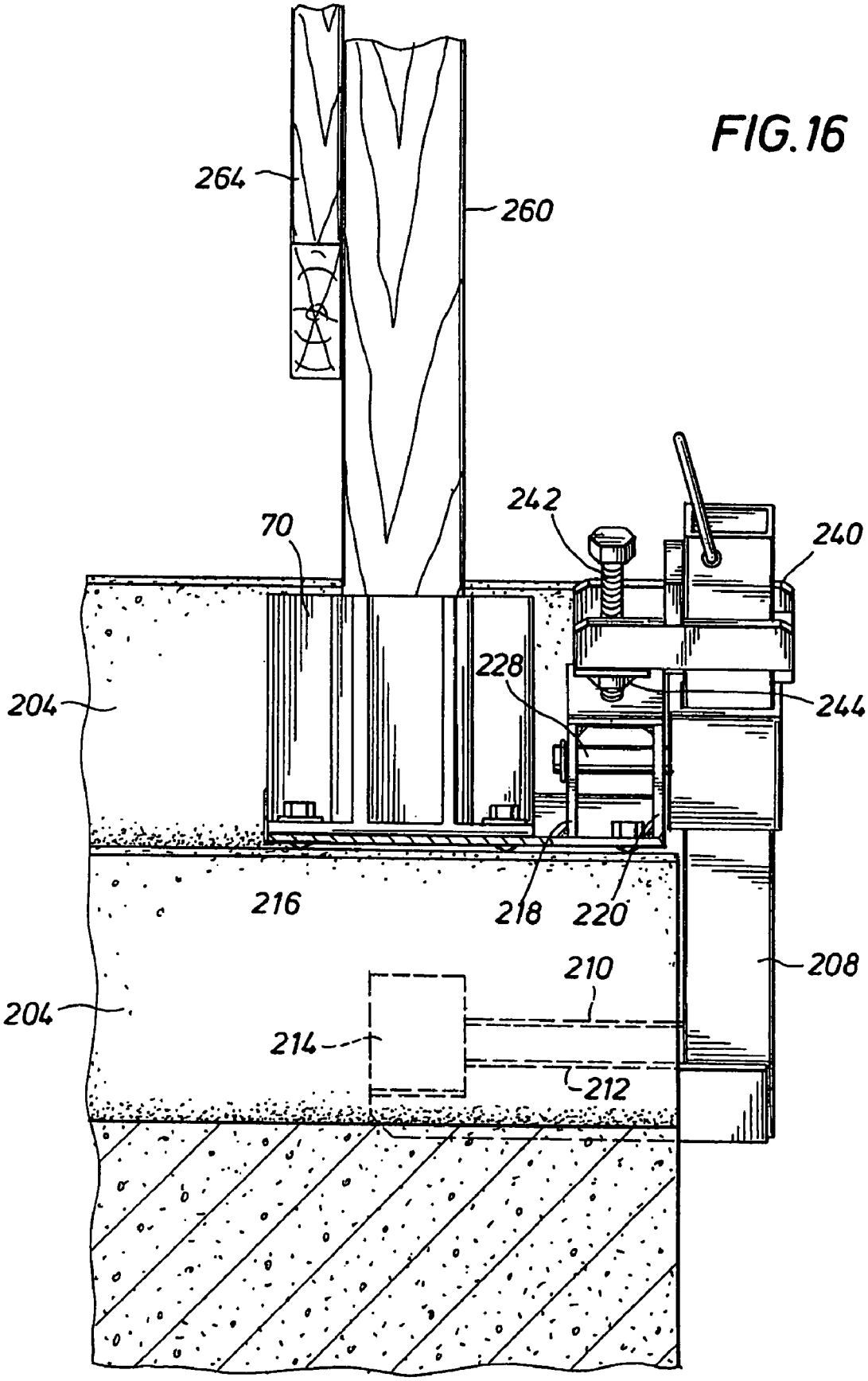

Referring now to FIGS. 15 and 16, there is shown an embodiment of the present invention suitable for use in clamping to the edge of a structural member having non-parallel spaced surfaces and/or spaced surfaces wherein one or more of the surfaces is at an angle to the horizontal. As shown, the apparatus shown in FIGS. 15 and 16 can be used in conjunction with the support or post holder 70 described with respect to FIG. 3 to erect a temporary rail on a pre-formed concrete stair.

The stairs, shown generally as 200 has a series of treads 202, which are generally horizontally disposed and interconnected by risers 204. The underside 206 of the stair 200 is at an angle to the horizontal and hence at an angle to the treads 202. The clamping apparatus has a stanchion 208 at the lower most end of which is attached a first clamping assembly comprised of side braces 210 and 212 to which are welded a pad 214, pad 214, as shown, being engageable with surface 206 of stairs 200. As in the case of the previous embodiments of the present invention, the clamping assembly has a support plate 216 to which is attached holder 70 in the same manner as described above with respect to the embodiment of FIG. 3. Support plate 216, in turn, is attached to a back plate 218 and a spaced, front plate 220, plates 218 and 220 extending upwardly from support plate 216. As best seen in FIG. 16, plates 218 and 220 are spanned by and connected to a series of bearing plates 222, 224 and 226. Bearing plates 222, 224 and 226, as seen in FIG. 15, form a trapezoidal structure.

As can also be seen, back plate and face plate 218 and 220 are connected to support plate 216, such that any compressive force urged against any of bearing plates 222, 224 and 226 is transferred to support plate 216. Plates 218 and 220 have registering bores in which is journal ed a shaft 228. One end of shaft 228 is connected to a collar 230, which is slidably mounted on stanchion 208. Since shaft 228 is rotatably journal ed in plates 218 and 220, collar 230 and hence stanchion 218 are rotatable relative to support plates 222, 224 and 226 or support plate 216. A collar 240 similar to component 30A shown in FIG. 3 is also slidably mounted on stanchion 208 and carries a threaded bolt 242 that is received in a threaded receptacle 244 attached to collar 240. As shown, bolt 242 can be tightened against bearing plate 222 with the result that pad 214 and support plate 216 will compressively engage surface 206 and tread 202. To enhance the compressive engagement, support plate 216 is provided with upturned flanges 216A and 216B of one of which, 216A, nests in the corner between the tread 202 and the riser 204. As can be seen in FIG. 15, the apparatus disclosed in FIGS. 15 and 16 can be used on either side of a stair to form a temporary guard rail. For example, if the apparatus were attached to the opposite side of the stair from that shown in FIGS. 15 and 16, bearing plate 226 will be engaged by bolt 242. Likewise, the apparatus shown in FIGS. 15 and 16 can be used on a slab that has generally parallel upper and lower surfaces and in that event, bearing plate 224 would be engaged by bolt 242. Once the clamping apparatus and holder 70 are in place, a temporary guard rail along the stair 200 can be erected, for example, by using two 2×4's, 260 and 262 received in holder 70 and attached by nails or the like to hand rails 264.

It will also be appreciated that the apparatus shown in FIGS. 15 and 16 can be used with the embodiments shown in FIGS. 10 and 12. In this regard, a socket forming member such as number 120 could be welded to support plate 216, as per FIG. 10, or a post 140 such as shown in FIG. 12 could be welded to support plate 216, in both cases the socket forming member and post also being secured, if desired, to the back plate 218.

The foregoing description and examples illustrate selected embodiments of the present invention. In light thereof, variations and modifications will be suggested to one skilled in the art, all of which are in the spirit and purview of this invention.

The invention claimed is:

1. Apparatus for use in erecting a temporary guard rail comprising:

a stanchion;

a first clamping assembly attached to said stanchion a second clamping assembly selectively, slidably moveable longitudinally along said stanchion, said second clamping assembly including a support plate extending laterally outwardly in a direction away from said stanchion, said second clamping assembly further including a first collar slidably moveable on said stanchion and a first frame attached to said first collar, said first frame including a force imparting assembly, said second clamping assembly further including a second collar slidably moveable, relative to said first collar, on said stanchion, said second collar being positioned between said first collar and said first clamping assembly, and a second frame attached to said second collar, said second frame comprising said support plate, said first and second clamping assemblies being adapted to clamp a structure therebetween when said first collar is fixedly positioned on said stanchion and said force imparting assembly applies a clamping force to said second collar; and a holder for a selectively removable post for said temporary guard rail, said holder comprising:

a base adapted to be removably attached to said support plate; and support walls upstanding from said base and defining an upwardly opening socket for receipt of said post, which provides a generally vertically, upwardly extending rail support for attaching to a transversely extending rail.

2. The apparatus of claim 1 wherein said force imparting assembly comprises a threaded receptacle, said threaded receptacle having a threaded bore, and a threaded tightening member threadedly received in said threaded bore.

3. The apparatus of claim 2 wherein said second frame includes a bearing plate longitudinally spaced from and connected to said support plate.

4. The apparatus of claim 3 wherein said bearing plate is compressively engaged by said tightening member when said first and second clamping assemblies have opposed structural surfaces clamped therebetween.

5. The apparatus of any of claims 1 or 3 wherein said first collar includes a dog and said stanchion has a series of longitudinally spaced openings whereby said dog can engage a preselected one of said openings upon movement of first said collar longitudinally along said stanchion.

6. The apparatus of any of claims 1 or 3 wherein said first collar includes a first tooth engageable with a first surface of said stanchion and a second tooth engageable with the opposite surface of said stanchion.

7. The apparatus of claim 1 wherein there are four of said support walls arranged to define a rectangular cross section to said socket.

8. The apparatus of claim 1 wherein there is a first pair of rail guide flanges directly adjoined and laterally projecting from a first one of said support walls.

9. The apparatus of claim 8 further comprising a second pair of parallel rail guide flanges directly adjoined to and laterally projecting from a second of said support walls opposite said first one of said support walls.

10. The apparatus of claim 1 wherein said base and said support plate have registering holes therethrough and there are connectors extending through said registering holes whereby said base can be connected to said support plate.

11. The apparatus of claim 10 wherein said support plate has a top side and a bottom side and there are formations extending outwardly in a direction away from said bottom side of said support plate for bitingly engaging a surface of a structure clamped between said first and second clamping assemblies.

12. The apparatus of claim 11 wherein said formations form part of said connectors.

13. The apparatus of claim 1 wherein said second collar is rotatably journaled on said second frame.

14. The apparatus of claim 13 wherein said second frame comprises first, second and third bearing plates spaced from said support plate.

15. The apparatus of claim 14 wherein said first, second and third bearing plates form a generally trapezoidal shape when viewed in transverse cross-section.

16. The apparatus of claim 14 wherein selected ones of said first, second and third bearing plates can be selectively, compressively engaged by said tightening member when said first and second clamping assemblies have opposed, structural surfaces clamped therebetween.

17. The apparatus of claim 1 wherein there are at least three support walls.

18. The apparatus of claim 1 wherein said holder is of monolithic construction.

19. Apparatus for use in erecting a temporary guard rail comprising:

a stanchion;

a first clamping assembly attached to said stanchion a second clamping assembly selectively, slidably moveable longitudinally along said stanchion, said second clamping assembly including a support plate extending laterally outwardly in a direction away from said stanchion, said second clamping assembly further including a first collar slidably moveable on said stanchion and a first frame attached to said first collar, said first frame including a force imparting assembly, said second clamping assembly further including a second collar slidably moveable, relative to said first collar, on said stanchion, said second collar being positioned between said first collar and said first clamping assembly, and a second frame attached to said second collar, said second frame comprising said support plate, said first and second clamping assemblies being adapted to clamp a structure therebetween when said first collar is fixedly positioned on said stanchion and force imparting assembly applies a clamping force to said second collar; and a holder for a selectively removable post for said temporary guard rail, said holder comprising:

a base adapted to be removably attached to said support plate;

at least three support walls upstanding from said base and defining an upwardly opening socket for receipt of said post; and at least one pair of rail guide flanges adjoining the base and projecting laterally outwardly with respect to one of the support walls, the spacing between the guide rail flanges being dimensioned so as to receive a toe board therebetween.

20. The apparatus of claim 19 wherein there are four support walls.

21. The apparatus of claim 20 wherein said post provides a generally vertically, upwardly extending support for a transversely extending rail.

22. The apparatus of claim 19 wherein said holder is of monolithic construction.

23. Apparatus for use in erecting a temporary guard rail comprising:

a stanchion;

a first clamping assembly attached to said stanchion a second clamping assembly selectively, slidably moveable longitudinally along said stanchion, said second clamping assembly including a support plate extending laterally outwardly in a direction away from said stanchion, said second clamping assembly further including a first collar slidably moveable on said stanchion and a first frame attached to said first collar, said first frame including a force imparting assembly, said second clamping assembly further including a second collar slidably moveable. relative to said first collar, on said stanchion, said second collar being positioned between said first collar and said first clamping assembly, and a second frame attached to said second collar. said second frame comprising said support plate, said first and second clamping assemblies being adapted to clamp a structure therebetween when said first collar is fixedly positioned on said stanchion and force imparting assembly applies a clamping force to said second collar; and a holder for a selectively removable post for said temporary guard rail, said holder comprising:

a base adapted to be removably attached to said support plate;

support walls monolithic with and upstanding from said base and defining an upwardly opening socket for receipt of said post; and at least one pair of rail guide flanges adjoining the base and projecting laterally outwardly with respect to one of the support walls, the spacing between the guide rail flanges being dimensioned so as to receive a toe board therebetween.

* * * * *